US009480986B2

(12) United States Patent
Schmid et al.

(10) Patent No.: US 9,480,986 B2
(45) Date of Patent: Nov. 1, 2016

(54) IMAGE PROJECTION METHOD AND APPARATUS FOR SUPPORTING MANUAL MALDI SAMPLE PREPARATION

(71) Applicants: Christian Schmid, Munich (DE); Martin Schürenberg, Tarmstedt (DE)

(72) Inventors: Christian Schmid, Munich (DE); Martin Schürenberg, Tarmstedt (DE)

(73) Assignee: BRUCKER DALTONIK GMBH, Bremen (DE)

( * ) Notice: Subject to any disclaimer, the term of this patent is extended or adjusted under 35 U.S.C. 154(b) by 114 days.

(21) Appl. No.: 13/625,275

(22) Filed: Sep. 24, 2012

(65) Prior Publication Data

US 2013/0323406 A1 Dec. 5, 2013

(30) Foreign Application Priority Data

May 30, 2012 (EP) ..... 12170042

(51) Int. Cl.
*B01L 9/00* (2006.01)
*B01L 99/00* (2010.01)
*H01J 49/04* (2006.01)

(52) U.S. Cl.
CPC ..... *B01L 9/50* (2013.01); *B01L 9/523* (2013.01); *B01L 99/00* (2013.01); *H01J 49/0418* (2013.01); *B01L 2200/0621* (2013.01); *B01L 2300/02* (2013.01); *B01L 2300/0627* (2013.01); *B01L 2300/0829* (2013.01)

(58) Field of Classification Search
CPC ..... B01L 99/00
USPC ..... 73/864.91
See application file for complete search history.

(56) References Cited

U.S. PATENT DOCUMENTS

| | | | | |
|---|---|---|---|---|
| 4,692,609 | A | 9/1987 | Pettersson | |
| 7,544,330 | B2 * | 6/2009 | Ryle | 422/500 |
| 2002/0191864 | A1 | 12/2002 | Lennon | |
| 2005/0046847 | A1 | 3/2005 | Cromwell | |
| 2005/0102056 | A1 * | 5/2005 | Du | 700/214 |
| 2007/0051899 | A1 * | 3/2007 | Truche et al. | 250/423 P |
| 2007/0072168 | A1 | 3/2007 | Ryle | |
| 2008/0305012 | A1 | 12/2008 | Camenisch | |
| 2013/0302847 | A1 * | 11/2013 | Mix | 435/29 |

FOREIGN PATENT DOCUMENTS

| | | | |
|---|---|---|---|
| DE | 102004020885 | A1 | 11/2005 |
| DE | 202005017946 | U1 | 2/2006 |

(Continued)

*Primary Examiner* — Christopher A Hixson
*Assistant Examiner* — Emily Berkeley
(74) *Attorney, Agent, or Firm* — Benoit & Cote, Inc.

(57) ABSTRACT

An improved deposition aid for manual sample preparation, particularly on flat MALDI sample supports, comprises a holder for a sample support with several sample sites, which is adapted to standardized sample supports for ionization with matrix-assisted laser desorption and a device which projects a two-dimensional optical image, or a suitable sequence of images, onto the sample sites. The image, or sequence of images, is constructed such that a selected sample site or group of selected sample sites is highlighted in a way which can be perceived by the human eye, at least with respect to neighboring, not-selected sample sites. The deposition aid also includes an interface for confirming the manual deposition and/or a device for the automatic detection of a manual deposition process; and a guidance system which selects a sample site or group of sample sites, and controls the device accordingly.

15 Claims, 4 Drawing Sheets

(56) References Cited

FOREIGN PATENT DOCUMENTS

| | | | | |
|---|---|---|---|---|
| DE | 202007018535 | U1 | 1/2009 | |
| DE | 102010052975 | A1 * | 5/2012 | ..... H01J 49/04 |
| DE | WO 2012072467 | A2 * | 6/2012 | ..... H01J 49/0413 |
| EP | 1763061 | A2 | 3/2007 | |
| FR | 2649511 | A1 | 1/1991 | |
| WO | 8300047 | A1 | 1/1983 | |
| WO | 2007038521 | A1 | 4/2007 | |
| WO | 2007071575 | A1 | 6/2007 | |
| WO | 2007121324 | A1 | 10/2007 | |
| WO | 2012072467 | A2 | 6/2012 | |
| WO | 2012072468 | A2 | 6/2012 | |

* cited by examiner

IMAGE PROJECTION METHOD AND APPARATUS FOR SUPPORTING MANUAL MALDI SAMPLE PREPARATION

BACKGROUND

The invention relates to a method which assists the manual preparation of samples on a sample support for ionization with matrix-assisted laser desorption and a corresponding deposition aid. Deposition aids have become known in the prior art particularly for use with microtitration plates. German utility model DE 20 2007 018 535 U1 describes a pipetting aid for transparent microtitration plates, which are placed into a base plate with the aid of an adapter. The base plate contains light sources, which are each assigned to an opening in the adapter and a cavity of the transparent microtitration plate. A switching or control unit activates the light sources independently of each other, and the illumination through the adapter and the transparent plate indicates where a sample liquid is to be pipetted. German utility model DE 20 2005 017 946 U1 concerns a similar structure.

In contrast to microtitration plates, sample supports for ionization with matrix-assisted laser desorption are generally opaque. This is a result of their electrical conductivity that serves to prevent static charges from forming on the sample support during the laser desorption. Electrical conductivity is fundamentally undesirable for microtitration plates because the cavities provide a larger interaction area with the sample liquid contained in the cavities, unlike MALDI sample supports with their flat sample sites, which are largely designed to be flush with the rest of the surface. This enlarged interaction area can—if it is conductive and the samples are liquid—promote undesirable boundary layer processes, for example the deposition of charge carriers dissolved in the liquid, such as salts, or chemical boundary layer reactions.

In a similar manner to the above-mentioned utility models, patent document U.S. Pat. No. 4,692,609 A describes a holder for a transparent microtitration plate, on whose base several light sources are arranged in such a way that they can illuminate a well of the plate from below in order to indicate to users where they are to pipette the liquid. Alternatively, the plate can be illuminated from the front by a guidable light source, although the patent document does not disclose a design for a guidable light source.

Publication WO 2007/038521 A1 shows an arrangement with a telescopic arm with a light source mounted at its end. The arm can be extended with the aid of an actuator so that the light source can be positioned vertically above each well of the microtitration plate to provide the illumination. This arrangement has the disadvantage that the light source itself, together with its holder, has to be moved each time it is positioned over a specific well, which imposes increased demands on the mechatronic actuators.

Further publications which deal with sample preparation on microtitration plates are FR 2 649 511, US 2005/0046847 A1, WO 83/00047 A1, WO 2007/071575 A1 and WO 2007/121324 A1.

Publication US 2002/0191864 A1 discloses the use of an image to identify the sample areas on the sample support which have been deposited with a sample, and to align the laser beam onto these areas. A method which assists the manual preparation of a MALDI sample support is not disclosed, however.

Publication EP 1 763 061 A2 concerns, among other things, the monitoring of deposition processes on MALDI sample supports with the aid of an imaging workstation.

Patent application laid open to inspection DE 10 2004 020 885 A1 is concerned with the preparation of samples of microbial origin on MALDI sample supports with the objective of automating the transfer of biological material from agar plates to sample sites on MALDI sample supports. To this end, agar plates are transported, via a conveyor belt, to a robot and set down on a 3D stage. An image processing system detects individual colonies on the agar plate and positions a sampling rod accordingly. An individual sampling rod is used for one single transfer only and is replaced afterwards. In order to take up biological material, the sampling rod is released from a holder and drops from a height of a few millimeters onto the colony. The contact with the colony thus achieved is designed to guarantee that only biological material adheres to the sampling rod, and no agar is transferred onto the MALDI sample support. If too much agar is transferred onto the MALDI sample support, the quality of the mass spectrometric identification is reduced because agar suppresses the signals of the characteristic protein ions. A fine sensor system to control the contact is not provided. The sampling rod does, however, vibrate, and it can be wetted with water before the sampling in order that a sufficient quantity of biological material from a colony adheres to the sampling rod and can be transferred onto a sample site of a MALDI sample support.

There is thus still a need to create an improved deposition aid for sample preparation on sample supports for ionization with matrix-assisted laser desorption.

SUMMARY

In accordance with the principles of the invention, a deposition aid for the manual preparation of samples on a sample support for ionization with matrix-assisted laser desorption comprises a holder for a sample support having several sample sites. The holder is preferably adapted to standardized sample supports for ionization with matrix-assisted laser desorption. A two-dimensional optical image, or a suitable sequence of images, is projected onto the sample support on the side on which the sample sites are located when the sample support is positioned in the holder. The image or sequence of images is configured such that a selected sample site, or group of selected sample sites, is highlighted in a manner that can be perceived by the human eye, at least with respect to neighboring, not-selected sample sites. Furthermore, an interface for manually confirming the deposition and/or a device for the automatic detection of a manual deposition process is provided. A guidance system enables a sample site, or group of sample sites, to be selected and the device to be controlled appropriately.

The term "two-dimensional image" is to be understood in a wide sense in the context of the present disclosure. It is possible, for example, to project two two-dimensional images onto the sample support in rapid succession so that an observer has the impression that a three-dimensional image is created on the front of the sample support, possibly by using an aid such as special eyeglasses. One component of such a "3D" image could also be a two-dimensional image, however.

The device is preferably equipped with a spatial light modulator, a liquid crystal projector or liquid crystal on silicon projector. It is thus possible to generate a very flexible image, or a very varied sequence of images, on the sample support with conventional video projection methods.

The front of the sample support thus acts as the "screen" for the projected image, so to speak. There are virtually no limits to the design of the image in terms of color selection for the individual pixels, brightness and/or image sequence.

Spatial light modulators are used particularly in video projectors, such as those marketed by Texas Instruments, Inc. (Dallas, United States of America), for example, under the name Digital Light Processing (DLP). Such a spatial light modulator essentially consists of micromirror actuators arranged in a matrix, that is, tiltable reflecting surfaces with short edge lengths, which can be accommodated in very large numbers on a small space such as a microchip. The motion of the actuators is caused by the force of electrostatic fields. The angle of each micromirror can be changed individually, and each micromirror usually has two stable final states between which it can change with a frequency of several kilohertz. The brightness of a pixel can be set with the aid of the switching frequency. The number of mirrors corresponds to the resolution of the projected image, where one mirror can represent one or more pixels. Resolutions of up to 4160 by 2080 pixels are possible at the present time. Furthermore, very high-contrast images can be generated on a small area.

If a projection lamp which emits white light is used, and this light is reflected by the micromirrors, a color wheel on which filters of the primary colors (usually red, green and blue, but sometimes others also) rotate can be inserted into the light path in front of the spatial light modulator to generate a colored image. In order to achieve better brightness values for white, a white segment can also be added to the color wheel. According to the position of the color filter, the electronics change the partial image which is reflected by the modulator. The rotational speed of the color wheel and the inertia of the human eye mean that the partial images are added together to give the impression of a colored image. A smooth, transitionless color representation in the projection is ensured by the color wheel rotating at high speeds or by providing several color segments.

In another variant, the color representation is achieved by splitting the light of the projection lamp into the three primary colors red, green and blue by means of dichroic mirrors, and transmitting them individually to three different modulators. The respective partial reflections can then be added together in a dichroic prism, which contains two crossed dichroic mirrors, to form a complete color image again. Additional sets of micromirrors are required for this variant. In some embodiments the color dispersion can also be brought about by a dichroic prism.

In further embodiments, individual colored light sources, for example individual LEDs (red, green, blue), can be used instead of a single white light source.

In various embodiments, the device can generate an image, or a sequence of images, by which a contrast in brightness and/or color is created at the selected sample site, or group of sample sites, at least with respect to neighboring, not-selected sample sites.

It is particularly preferable if the device generates a sequence of images which highlights a sample site, or group of sample sites, so as to catch the eye, for example by the image at the highlighted location of the sample site having a signal color (such as red, yellow or green) which the human eye perceives particularly well, while the other parts of the image or image sequence contain sober colors (such as gray or brown), which usually pale into the background compared to the signal colors. Flickering or flashing effects can also be achieved with sequences of images if, for example, a sequence of projected images has alternating areas of intensity and/or color.

The holder for the deposition aid is adapted, preferably geometrically, to standardized sample supports for ionization with matrix-assisted laser desorption. This adaptation can also be carried out using adapter pieces which are inserted into a holder. In this way, sample supports with different configurations or dimensions can be fitted in the holder. This makes it possible to arrange the sample supports in the holder so as to be flush and/or aligned. The standardization of the sample supports is defined in particular via the geometric dimensions, such as height, length, width or area, the number of sample sites and/or their shape and/or their size or their (matrix) arrangement, particularly in rows and columns. It must also be borne in mind that sample supports which are used in time-of-flight mass spectrometers with axial ion injection and laser desorption methods must have a front surface which is as flat as possible in order to give the simplest possible boundary conditions for the electric fields created in the space in front of the sample support. This makes it easier to control the region in phase space (formed from position and momentum coordinates) which is taken up by the ions of interest created in the laser desorption. Cavities, as are incorporated into microtitration plates, are not suitable for these devices.

The device can operate in such a way that, at the selected sample site, it generates a contrast in brightness and/or color, at least with respect to the neighboring, not-selected sample sites. For example, a selected sample site can be illuminated with intensive yellow or red light, while the rest of the optical image has a rather low-intensity shade of gray.

The guidance system, as part of the deposition aid, can be equipped with an interface for data input or output. This is particularly useful if a user wishes to input a deposition plan of a sample support to be processed into the guidance system. The interface can, for example, also be used with manual input to confirm that a deposition process has been carried out. In this way, a sequence of deposition processes can be carried out with certainty. The interface can be expanded to include a telecommunication function for receiving sample origin data and/or corresponding identification tags, for example, which can then be stored with the deposition data and/or corresponding identification tags of the deposited sample sites in order for them to be assigned. The telecommunication function can also incorporate the transmission of corresponding data. The telecommunication function can be equipped with known telecommunication means such as wireless, BLUETOOTH®, infrared or any other interface.

The guidance system can, in addition, have a memory for the assignment and acquisition of identification tags of samples and sample sites. The assignments made are securely stored there and can be called up as often as required for subsequent evaluation or checking.

In one embodiment, the deposition aid can be stationary. It is then preferably located in an arrangement comprising a culture plate support, on which Petri dishes for the sampling process can be arranged, for example, and a sample feeding station for a mass spectrometer with a laser desorption device, so that the samples can be transferred from a culture plate in the culture plate support onto a sample support in the deposition aid, and from there to the feeding station in as time-saving a way as possible.

In a further variant, the deposition aid can also be designed to be portable. As a portable handheld unit, for example, the deposition aid can be carried by a user like a painter's palette in or on the hand. In this case, the deposition aid preferably has a holding device such as a grip, blind holes for the fingers of a human hand, or a holding strap with which it can be fastened to a user's arm. Portability can also be achieved by the deposition aid being designed like a vendor's tray, for example with at least one shoulder or neck strap so that users can carry it against their stomach or chest. This variant has the advantage that the user has both hands free. Portability makes the deposition aid more flexible to use, and particularly its use is then no longer limited to one location.

Together with the design of the deposition aid as a portable device, particularly a handheld one, a docking station can be provided, which is preferably stationary and has a holder for the deposition aid. If necessary, a user can put down the portable deposition aid carried on the body or in the hand by placing it in the holder, and is then free to carry on with different work for which the deposition aid is not required. In the docking station, the deposition aid can transfer data of an executed deposition sequence to a stationary computer situated in the station. Likewise, it would be possible and sensible to make an electrical connection in order to recharge any batteries used to power the deposition aid.

If a device for automated detection is present, it preferably includes a scattered light sensor. The scattered light sensor is preferably positioned above the holder and serves in particular to detect changes in the scattered light behavior, which indicate a manual deposition process, at the front of a sample support located in the holder. This detection is, particularly, spatially resolved. In addition to the variant with spatially resolved detection, it is also possible to specifically search for a scattered light signal from the sample site which is intended for the next deposition process to be undertaken (and is highlighted). In this second variant, the temporal correlation or synchronization of the visual highlighting with the detection of a scattered light event would be an important process. The scattered light can, in principle, originate from the optical image and/or a separately generated light beam which is projected onto the sample support (onto the highlighted sample site on the sample support, if applicable). For the spatially resolved detection of a manual deposition, a selected sample site can be illuminated individually before the deposition, and the resulting scattered light can be measured with an integrating scattered light sensor. The scattered light measurement can be repeated after the manual deposition has been confirmed by the user, or automatically at periodic intervals. From the differences in the scattered light intensities, or their absence, it is possible to deduce whether the selected sample site has been deposited correctly or incorrectly. For a group of selected sample sites, the scattered light measurement can be carried out individually in sequence for each of the sample sites of the group. The light for illuminating the individually selected sample sites is preferably produced with the device which casts the two-dimensional optical image onto the sample support, but can also be produced by an appropriate second device, particularly in the infrared spectral range, which cannot be visually perceived by the user. A sequence of images can be useful when evaluating the scattered light signal by means of frequency filters.

Additionally or alternatively to the scattered light sensor, it is possible to use a camera with image recognition for the automatic detection of the deposition.

Changes in the scattered light behavior can be detected very reliably, particularly on the surfaces of a MALDI sample support, which have a metallic shine. Once the sensor is aligned onto a sample site that is to be deposited, the deposition process means that, initially, a strongly varying scattered light signal is to be expected when users move their pipette or inoculation instrument through the light cone of the two-dimensional optical image, or through the light beam of the separate light source, for example. When the inoculation instrument is withdrawn, the changes in the scattered light behavior on the freshly deposited sample site result from the deposited sample (or they do not, if the deposition was not successful or occurred at the wrong site).

If more sample sites than just the one that is to be deposited next are monitored by the sensor, it is also possible to detect an erroneous deposition, if a scattered light change appears at a sample site other than the one selected for the next deposition. Similarly, it is possible to confirm a manual deposition via changes to the scattered light behavior of a part of the surface of the sample support. On the front of the sample support, for example, or alternatively on the periphery of the holder, a certain area not comprising any sample sites can be assigned for the deposition confirmation, and this area can be monitored with the scattered light sensor. After the completion of deposition, the user can move the inoculation instrument over the assigned area and thus generate a temporary scattered light change signal, which causes a connected processor to continue with the next sample site of a deposition sequence. The term periphery is to be understood broadly and should not only describe areas of the holder itself, but can also include (mainly peripheral) areas of the sample support.

In further embodiments, the image, or sequence of images, can be divided into an area which highlights the selected sample site or sites, and an area which displays information to the user. The information area can comprise a text message with information on the sample to be deposited.

The invention also discloses a method for assisting the manual preparation of samples on a flat sample support for ionization with matrix-assisted laser desorption. The first step is to provide a sample support with several sample sites. One or more selection criteria are then defined, according to which a deposition sequence is to be conducted. A set of sample sites is selected according to the one or more selection criteria. A two-dimensional optical image, or a suitable sequence of images, is cast onto the front of the flat sample support, where the sample sites are located; wherein the image, or sequence of images, is configured such that a selected sample site, or group of selected sample sites, is highlighted in a way which can be perceived by the human eye, at least with respect to neighboring, not-selected sample sites. A sample, or a substance for the preparation of a sample (for instance, a solution with a MALDI substance), is then deposited manually on the highlighted sample site. The completed deposition is confirmed manually and/or automatically detected by a sensor arrangement. If the set contains further unprocessed sample sites, or groups of sample sites, the highlighting and manual deposition steps can be repeated with the next sample site of the set, or the next group of sample sites. If not, the deposition sequence would be concluded for the time being.

A user wishing to carry out manual preparation of a sample support is assisted in depositing a sample taken, or prepared, from a nutrient medium—agar plate, bouillon or blood culture, for example—at the correct location by the visually recognizable highlighting with the image or image sequence. This assistance reduces the risk of deposition errors, which essentially occur because the tiny quantity of sample material transferred usually means that it is hardly perceptible to the eye.

The highlighting here is particularly intended to be reversible, that is, it can be activated and deactivated, for example by switching the projected image on or off (or by changing it). The work of a technician is also to be facilitated, particularly by the selection and highlighting being carried out (semi-) automatically with electronically assisted means. The procedural effort involved can be minimized if the highlighting of the selected sample site is limited to the immediately adjacent sample sites which have not been selected, for example by highlighting the relevant sample site with a section of the image which has a light color or high light intensity, whereas the immediately adjacent sample sites that are not to be highlighted are covered by a section of the image which is dark in color or has low light intensity. The highlighting effect can be enhanced by increasing the number of not-selected sample sites, in the extreme case so that the selected sample site is highlighted with respect to all other, not-selected sample sites. In this case the image or the image sequence is essentially projected onto the whole front surface of the sample support.

In the following, MALDI is given as the preferred type of ionization, where ions are created during the laser-induced desorption. However, it is clear that, in the present invention, only the laser desorption for transferring the analyte substances—that is, proteins or protein chains—into the gaseous phase is important. The type of ionization can be selected as required to suit the application. The laser desorption can be carried out with a chemical ionization (laser desorption chemical ionization—LDCI), for example, but other types of ionization can also be used. The term ionization with matrix-assisted laser desorption must be understood in a correspondingly broad sense.

The sample site can be selected according to whether it is empty. The method provides certain flexibility in different stages of a deposition sequence. A geometric method of selection is also possible, for example by specifying, for instance, that only every nth sample site is to be deposited—such as every second sample site. This may be advisable if the risk of cross-contamination by outgassing of a sample and transfer of the outgassed sample particles in the gas phase onto another sample site is increased by the deposited sample sites having little spatial separation. In one variant of the method, the selection can be carried out by an electronically assisted technical guidance system, where all empty sample sites are deposited, for example, or by a user of the method.

Several sample sites can be selected, and the highlighting can be carried out repeatedly in a deposition process where, with every repetition, a different selected sample site or a different group of selected sample sites is highlighted. The method is therefore particularly suitable for the sequential processing of different samples which originate from different colonies on a culture plate and are to be applied to a sample support. With such sequential processing it is preferable to use a monitoring and control system which assists the user of the method in selecting the samples to be transferred.

Furthermore, a method is proposed for the manual preparation of a sample on a sample support for ionization with matrix-assisted laser desorption, in which the sample and the sample sites are each provided with identification tags, and in which a sample site is selected and highlighted in accordance with a method described above, the sample is applied to the selected sample site, and the identification tags are assigned to each other and stored. In this way, after the completion of deposition of the sample support, it is possible to trace back and check which samples with which origin have been transferred onto a specific sample site. This allows a subsequent process control and can flag up an error, for example, if a sample of particular origin was deposited on two sample sites, although only one sample site was intended for each sample from the origin in question.

The assignment and storage can be carried out together in a combined method step or separately. The assignment can be carried out before the actual deposition process, for example, and the storage after the conclusion of the deposition process. A specific temporal sequence of the assignment and the storage during the method is not essential in principle. It is preferable, however, to assign and store the identification tags after the deposition process, because in this way an incorrect assignment or incorrect deposition can be more easily identified.

Samples of microbial origin are particularly suitable. This is preferably taken to mean the microorganisms themselves, in untreated form, as they were cultivated in or on a nutrient medium.

The identification tag of the sample can be derived from a labeling of the sample vessel—a Petri dish, for example—from which the sample originates. This ensures a high degree of certainty when tracing back a sample. It is also possible to generate or supplement an identification tag by means of a camera taking a picture of the sample source, particularly the flat nutrient medium in a Petri dish, and determining the coordinates of the sample's original site in the image by means of image processing, and assigning them to the sample. As an addition or alternative to an optical image of the flat nutrient medium, the sample's site of origin can also be identified by measuring the capacitance change in the flat nutrient medium before the sampling compared with after the sampling.

In one variant, the sample origin data and/or identification tags can be transmitted to the sample preparation instrumentation via telecommunications equipment in order to be stored there together with the deposition coordinates and/or the identification tags of the sample support or the sample site, once deposition of a sample site on a sample support is complete. It is thus possible to undertake a particularly detailed sample trace-back.

BRIEF DESCRIPTION OF THE DRAWINGS

In the following, the invention is described with the aid of example embodiments in conjunction with the attached drawings. The drawings comprise.

DETAILED DESCRIPTION

Figure 1A:
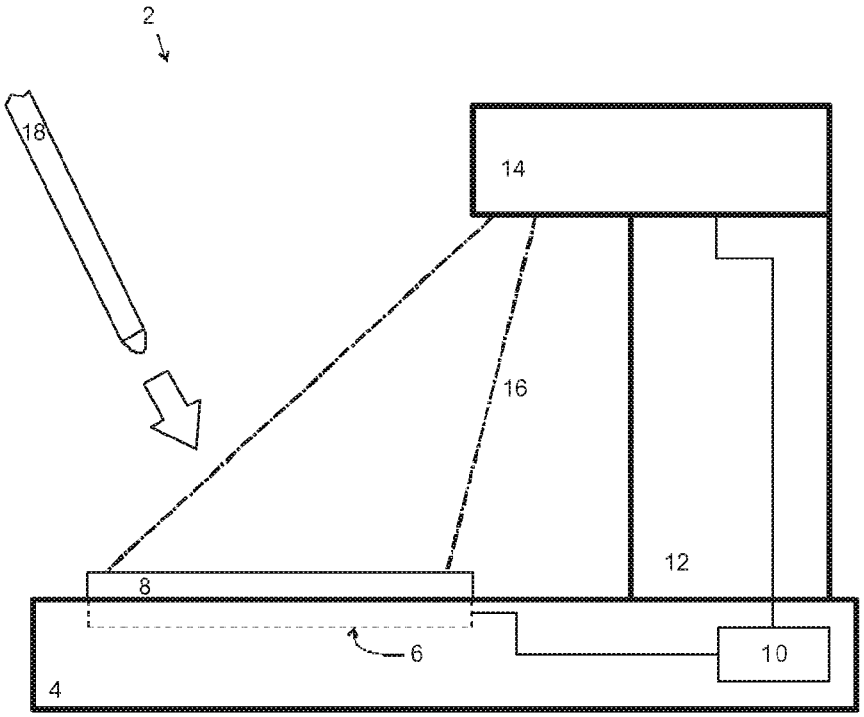
FIG. 1A-C illustrating a schematic design of a deposition aid according to principles of the invention.

FIG. 1A is a schematic representation of the design of a deposition aid 2 according to the principles of the invention. A base plate 4 contains a holder 6, whose internal dimensions are preferably adapted to the standardized external dimensions of an LDI sample support 8 (in particular a MALDI sample support). In certain cases, adapter pieces (not shown here) can be used to adjust the holder 6 to a required spatial configuration.

In FIG. 1A, a sample support 8 is located in the holder 6. A sensor (not shown), can be integrated in the base and/or side area of the holder to detect the presence of a sample support and transmit an appropriate information signal to a guidance system 10, for example, a microprocessor integrated into the design. The sensor can consist of a simple pushbutton, for example, which is activated when the sample support 8 is inserted into the holder 6. Other, particularly non-contact sensor versions (ultrasonic proximity sensor, light barrier, . . . ) are also conceivable, however.

A holder in the deposition aid can also take the form of a frame (not shown). A frame which fixes the sample support at the narrow sides has the advantage that both the front and back of the sample support are accessible to measuring and inspection instruments (possibly a sensor arrangement). This facilitates the handling of the deposition aid, particularly if it is portable.

On one side of the base plate 4 is a vertical arm or support 12 on which an imaging device 14 is located. The imaging device 14 can be designed like a video projector, for example, as is explained further below. The imaging device 14 is positioned and aligned in such a way that it can project a two-dimensional visual image 16, or a suitable sequence of images, onto the front of a sample support 8 which is located in the holder 6. The imaging device 14 communicates with the guidance system 10 and is controlled by it, for example in order to specify which image is to be projected so as to highlight a sample site or group of sample sites. The imaging device 14 preferably contains a range of optics which ensures that the image, or sequence of images, is displayed without any distortion in spite of being projected onto the front of the sample support sideways at a certain angle.

The imaging device 14 is positioned in such a way that a user can transfer a microbiological sample, for example cells from a microbial colony cultured on an agar plate, to a sample site on the sample support 8 with an inoculation instrument 18 or similar transfer device largely unhindered.

It is possible for the guidance system 10 to have an interface (not shown) with which a user can manually confirm that a sample site has been manually deposited. The term "manually confirm" is here to be understood in a broad sense and may also comprise the input of identification data of the next sample to be prepared, for example by scanning a bar code on an agar plate.

Also not shown here is a variant where the guidance system 10 is equipped with a sensor arrangement for the automated detection of deposition processes, and thus the completion of a sample site deposition is automatically recognized and reported to the guidance system 10. The automated detection can, of course, also include the detection of erroneous deposition, that is, if a sample has been deposited on a different sample site to the one intended.

Examples for such a sensor arrangement are described in the international patent application WO 2012/072467 A2 assigned to Bruker Daltonik GmbH, which is hereby incorporated by reference in its entirety into the present disclosure. For example, the quantity of sample at a sample site can be probed, or the deposition state of the sample site can be determined, by means of a change in at least one of the following chemophysical properties: resonance frequency of a piezoelectric material, density, geometrical dimension, propagation time of ultrasonic or electromagnetic waves, electrical capacitance, electrical resistance, inductance, permittivity, magnetizability, light scattering, light absorption, light reflection or luminescence. Variants with light barrier beams which intersect above the sample sites, thereby forming a monitoring grid, are also conceivable.

A further telecommunication connection to the sample support 8 can be provided to enable the guidance system 10 to acquire certain configuration data of the sample support 8, such as the number, arrangement and position of the individual sample sites. In one example, a microchip which is mounted on the sample support 8 and which contains the appropriate configuration data can be read out. As an alternative, the guidance system 10 can also be equipped with a camera and an optical image recognition system (not shown here), or can communicate with these; the camera images the front of the sample support 8 so that detectable features of the sample sites can be located for the depositing of sample material. These detectable features can take the form of markings, for example circular outlines, on the front of the sample support.

Communication with the device 14 also allows the guidance system 10 in this example to (de-)activate a video projector in order to generate an optical image on the front of the sample support, to change the image, and to select different image formats where necessary. The acquisition of the configuration data, the selection of an image (or sequence of images) as well as the (de-)activation of the projector can also be done manually via an interface in some example embodiments.

In a semi-automatic embodiment, a user of the deposition aid can input the deposition state of the sample support 8 into the guidance system 10, via an interface, for example. At the same time, the user can specify the criterion according to which the sample sites are to be selected. This can be an empty state, for example. The guidance system 10 then checks which of the sample sites is suitable for deposition, selects one of them (or possibly a group) in order to highlight the appropriate sample site, selects the image to be projected accordingly, or generates it, and activates the video projector. An image, or sequence of images, is then projected onto the front of the sample support 8, where a sample site, and possibly the surrounding area on the front of the sample support, is highlighted in a way visible to the human eye with respect to the other areas of the sample support with not-selected sample sites.

The highlighting effect can be amplified by designing the sample support material so that it enhances the visual effect, for example by incorporating particles which glitter or create a color effect when illuminated into the material of the sample support 8. A type of bright primer with white particles can be useful in order to make color differences in the different pixels stand out better.

Supported by this highlighting, the user can deposit the sample onto the correct sample site, and then manually confirm that deposition has taken place via the interface, for example. This can then lead to the deactivation of the highlighting, that is, in this example to the projection being switched off, or to the image shown being changed. In other embodiments, a sensor arrangement for the automatic detection of manual deposition processes can be used.

The front of the sample support can be given an antiglare coating so that users are not irritated as they work. This can prevent dazzling light reflections which could occur as the image or sequence of images is projected. However, the risk of dazzling when a projector is used for generating an image on the sample support is essentially small, in contrast to bundled light beams.

The guidance system 10 can be provided with a memory (not shown) for the assignment and acquisition of identification tags of samples and sample sites. If required, this information can be entered by a user via the interface or it can be read in; alternatively via automated data transmission.

Figure 1B:
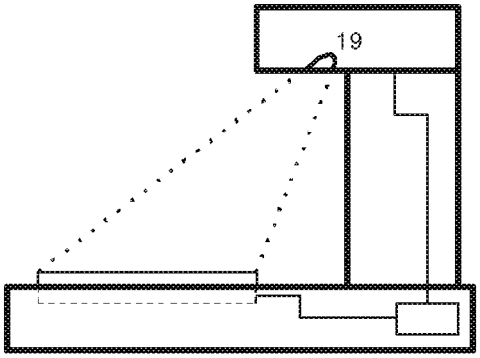

According to a further embodiment, it is also possible for a scattered light sensor 19 to be installed on the support 12 (as indicated in FIG. 1B); this sensor monitors the front of the sample support 8 with spatial resolution in order to detect changes in the scattered light behavior and to assign these changes to an area on the sample support, for example a sample site. The spatial resolution can be achieved with a charge-coupled device (CCD) and appropriate upstream optics, for example. The light which is scattered on the surface of the sample support 8 and then detected can originate from the projector of the imaging device 14 or from a separate light source (not shown). The scattered light sensor 19 can also measure the integrated (not spatially resolved) scattered light which originates from a sample site if the sample site is illuminated individually by the imaging device 14 or the separate light source.

Figure 1C:
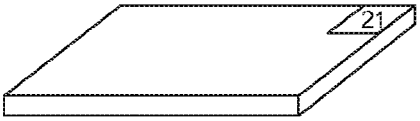

Moreover, a specific area 21 (FIG. 1C) can be identified on the sample support 8 as confirmation of a completed deposition process. After the sample has been deposited, the user can swipe the inoculation instrument across area 21 and thus trigger a scattered light pulse which indicates the conclusion of a deposition process and thus leads to the continuation of a deposition sequence. This is an example of an interface for confirming a deposition. Of course, in order to avoid unnecessary erroneous signals, the area 21 should be located on a side of the sample support from which a user does not access the sample sites. In alternative embodiments, the area can be arranged on part of the periphery of the holder, not on the sample support itself.

Figure 2:
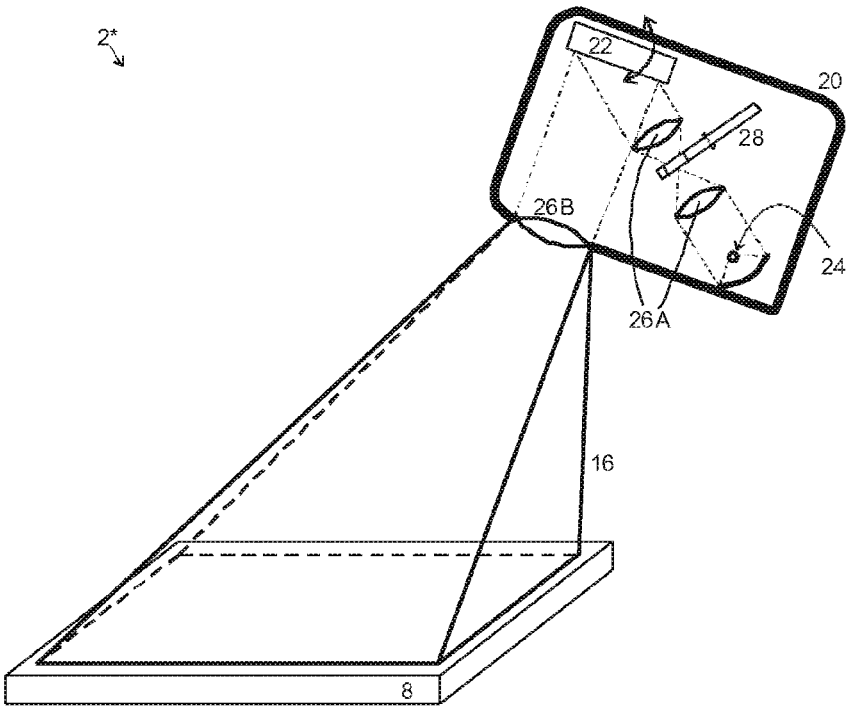
FIG. 2 illustrating a more detailed (schematic) representation of a projection method.

FIG. 2 shows in somewhat more detail an example embodiment of a deposition aid 2* according to principles of the invention.

In this example, the highlighting device has a spatial light modulator, which is located in a housing 20. The housing 20 is supported by a support or holder (not shown here in order to simplify the illustration). Spatial light modulators are only one example of a video projection technique. Liquid crystal projectors or liquid crystal on silicon projectors can also be used. Such projectors have the advantage that they can generate a very flexible image 16, or a very versatile sequence of images, on the sample support 8. There are virtually no limits to the design of the image 16 in terms of the color selection for the individual pixels, brightness and/or image sequence.

Schematically represented in the housing 20 is a micromirror actuator 22, onto which light is projected by a suitable projection lamp 24 via imaging optics 26A. The image passes from the micromirror 22 via further imaging optics 26B onto the front of a sample support 8. Micromirror actuators 22 can be accommodated in very large numbers on a small space such as a microchip. The angle of each micromirror 22 can be changed individually, and each micromirror usually has two stable final states between which it can change with a frequency of several kilohertz. The brightness of a pixel can be set with the aid of the switching frequency. The number of mirrors corresponds to the resolution of the projected image 16, where one mirror can represent one or more pixels. Resolutions of up to 4160 by 2080 pixels, and thus very high-contrast images, are possible on a small area. In practice, however, a resolution of 480 by 320 pixels can also provide satisfactory results. It is, of course, possible to select even lower resolutions if the particular application allows this.

In order to generate a colored image, in this example a color wheel 28, on which filters of the primary colors (usually red, green and blue, but sometimes others also) are rotated, is inserted into the light path in front of the micromirror actuator 22. In order to achieve better brightness values for white, a white segment can also be added to the color wheel 28. According to the position of the color filter, the electronics change the partial image which is reflected by the modulator 22. The rotational speed of the color wheel 28 and the inertia of the human eye mean that the partial images are added together to give the impression of a colored image. A smooth, transitionless color representation in the projection is ensured by the color wheel 28 rotating at high speeds or by providing several color segments. In several embodiments, the color dispersion can also be brought about by a dichroic prism.

In another variant (not shown) the color representation is achieved by splitting the light of the projection lamp into the three primary colors red, green and blue by means of dichroic mirrors, and transmitting them individually to three different modulators. The respective partial reflections can then be added together in a dichroic prism, which contains two crossed dichroic mirrors, to form a complete color image again, for example.

Of course, it is also possible to use individual colored light sources, for example individual LEDs (red, green, blue), instead of a single white light source.

Figure 3:
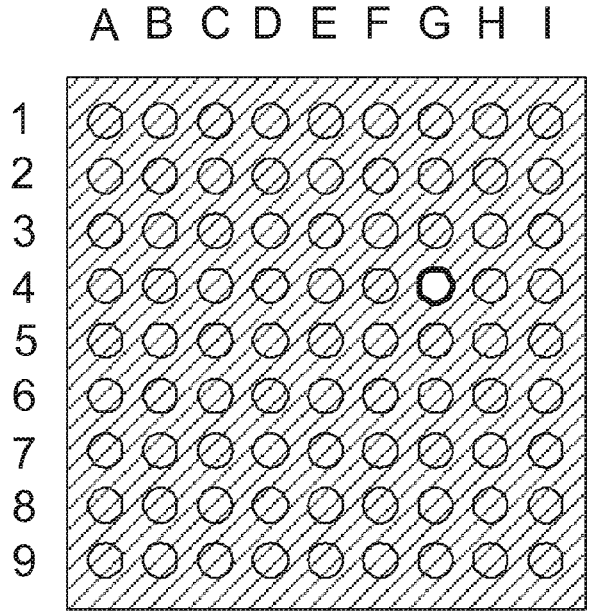
FIG. 3 illustrating an example of a projected image.

FIG. 3 shows a simple example of a projected image which highlights one sample site on a sample support with respect to others. In this example, the sample support has 9×9 sample sites in a matrix arrangement (columns A to I and rows 1 to 9). The projected image covers the whole area of the front of the sample support in this case. In some embodiments, only partial areas of the sample support may act as the "projection screen" for the image. In other variants, the image or sequence of images extends beyond the edges of the sample support. At the location of the sample site G4, the optical image has a high brightness and/or color contrast compared to the other sample sites on the sample support. A color contrast can be achieved by using yellow against light gray (hatched), for example. A brightness contrast would result, for example, if the intensity of white light on the selected sample site G4 is higher (in one example ten times higher) than in the surrounding areas. The image to be projected can be generated autonomously by a guidance system in accordance with the acquired configuration data of the sample support. Alternatively, it can be specified by a user.

By color coding the highlighting, it is possible to indicate to a user whether a selected sample site is to be deposited with a sample, or with which substance a selected sample site is to be deposited, in a next deposition step. Alternatively, a specific color could indicate the deposition state of the selected sample site. A bright white could represent an empty sample site, for example, yellow a sample site which is deposited with a microbial sample, red a digestion or extraction substance, and green a matrix solution. There are virtually no limits to the variability of the present method in this respect.

Figures 4A, 4B, 4C:
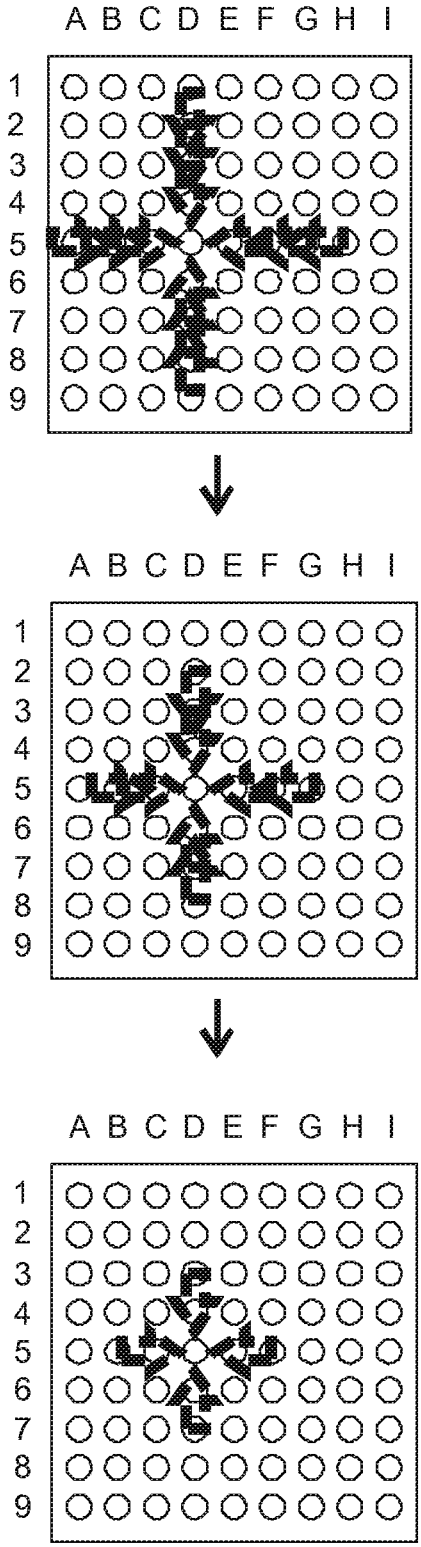
FIG. 4A-C illustrating an example of a projected sequence of images.

FIGS. 4A, 4B and 4C show an example embodiment where a sequence of images is projected onto the front of a sample support. The image sequence comprises two pairs of opposing arrows, perpendicular to each other, with the tips of all the arrows pointing to a selected sample site D5. In the image sequence, the arrows can move inwards, nearer and nearer to the location of the sample site D5, with each subsequent image of the image sequence, until the arrow tips appear to touch the external outlines of the sample site D5.

Of course, it is also possible to use a single image, such as in FIG. 4C, without any animation to highlight the sample site D5.

Figure 5:
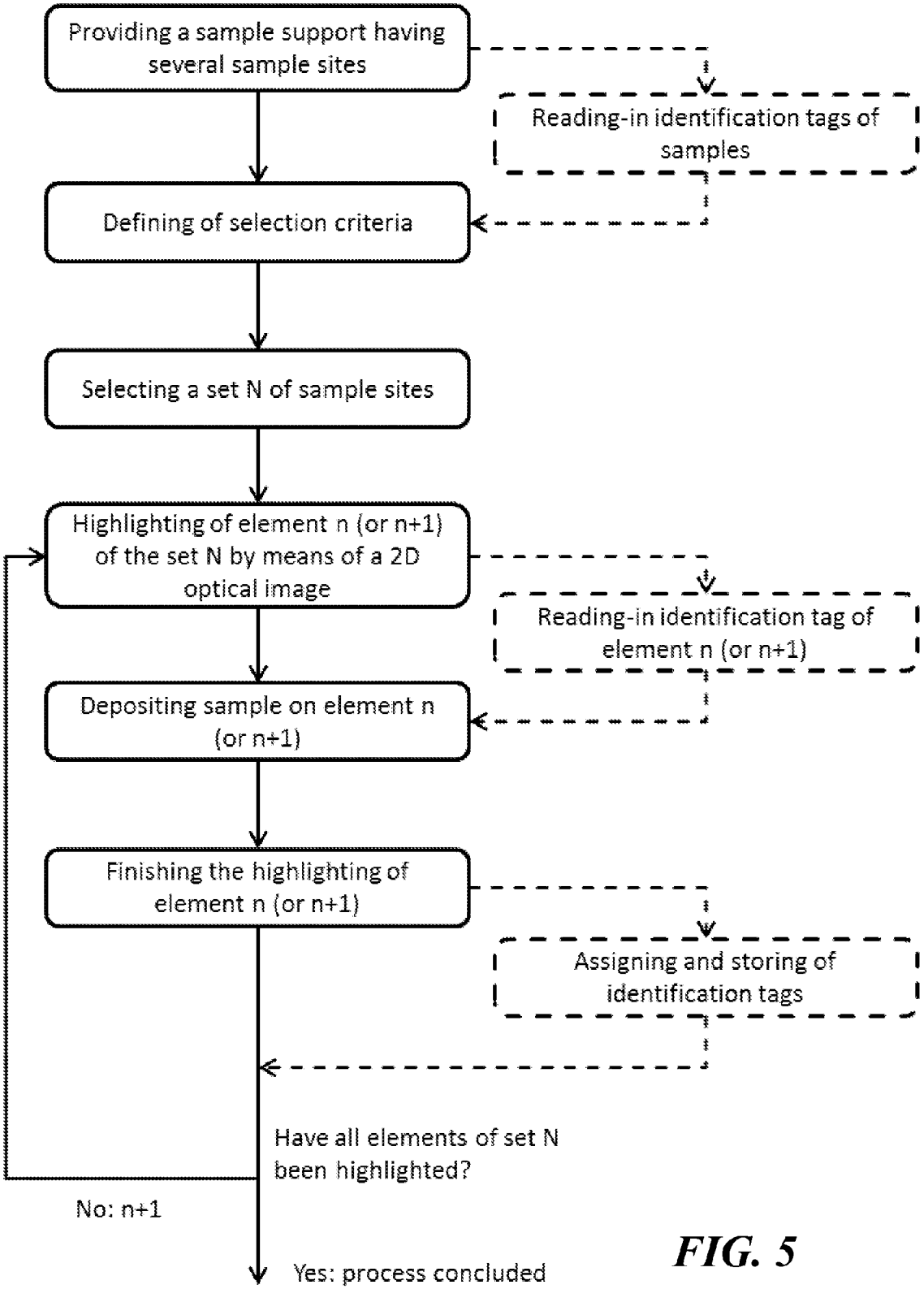
FIG. 5 illustrating a flowchart representing methods according to principles of the invention.

FIG. 5 shows an exemplary sequence of steps of a method according to the invention as a flow diagram: a sample support for ionization with matrix-assisted laser desorption with several sample sites is provided. This can be a MALDI sample support, which does not need to be transparent. It can be a flat metal plate or a plate made of a conductive plastic or a doped semiconductor, such as silicon. Moreover, a Petri dish is provided which contains a flat nutrient medium, on which colonies of microorganisms have been cultured. Pellets obtained by centrifugation or filtration can also serve as sources of samples. The Petri dish mentioned here by way of example can be equipped with a barcode as an identification tag, which is read in with an optional method step, by optical scanning, for example. Additionally or alternatively, an RFID chip carrying an identification tag, which could be read out via wireless communication, would be a possibility (albeit being more complex/costly). The arrangement of the colonies on the nutrient medium can be photographed with a camera and evaluated with regard to the exact positioning of the individual colonies, using the XY-coordinates of the individual colonies on the flat nutrient medium, for example. With this information, the identification tag of the nutrient medium carrier, particularly the Petri dish, can be supplemented sample-by-sample or colony-by-colony, and thus specified in more detail.

Next, a selection criterion or criteria can be defined, according to which the deposition sequence is to be carried out. Possible criteria for the selection can be, for example: a selection according to the numbering (for example deposition of every nth [empty] sample site), random selection, or selection using an exclusion list of already prepared sample sites. The sequence of deposition in the sample sites which fulfill the criteria and are therefore selected can, in principle, be specified at will. For example, it can follow a sequential numbering of the relevant sample sites on the sample support from lower numbers to higher numbers.

An optical image, or sequence of images, is now projected onto the sample support in such a way that the first selected sample site—or in another variant, several sample sites—is highlighted with respect to other sample sites. The selected site(s) can now be deposited manually by a technician. Optionally, an identification tag of the highlighted sample site can be entered between these steps in order to allow subsequent tracing back to the sample's site of origin. At the conclusion of the deposition process, the highlighting can be ended; in the case of a video projection, this can be switched off, for example. Alternatively, the image projected can be changed. Optionally, the identification tags can then be assigned to each other and stored on a suitable storage medium, particularly an electronic memory. If more than one sample site fulfills the selection criteria, it is now possible to iteratively process all the other selected sample sites until none of the selected sample sites remains. It goes without saying that a further, not explicitly stated, criterion for the termination of the iteration consists in there being no more samples to be transferred to the sample support.

While the invention has been shown and described with reference to a number of embodiments thereof, it will be recognized by those skilled in the art that various changes in form and detail may be made herein without departing from the spirit and scope of the invention as defined by the appended claims.

What is claimed is:

1. A deposition aid for manual preparation of samples on a sample support for subsequent ionization via matrix-assisted laser desorption, the aid comprising:

a base plate containing a holder for a sample support which has several sample sites;

a microprocessor or equivalent thereof, which selects one of the several sample sites, based on configuration data of the sample sites on the sample support;

a vertical support located at one side of the base plate;

a video projector mounted on the vertical support that communicates with and is controlled by the microprocessor or equivalent thereof and projects onto at least a portion of the sample sites, at a non-orthogonal angle relative to a plane of the sample support, at least one two-dimensional optical image that is constructed so that the selected sample site is highlighted with respect to neighboring, not-selected sample sites in a manner which can be perceived by the human eye; and optics, including at least one of a lens and a mirror, that condition the image to be displayed substantially without distortion.

2. The deposition aid of claim 1 wherein the projector projects a sequence of images onto the sample sites.

3. The deposition aid of claim 1, wherein the projector comprises one of a spatial light modulator, a liquid crystal projector and a liquid-crystal-on-silicon projector.

4. The deposition aid of claim 1, wherein the projector generates the at least one image with at least one of a brightness contrast and a color contrast at the selected sample site in order to highlight the selected sample site.

5. The deposition aid of claim 1, wherein the projector generates a sequence of images which highlights a group of sample sites with respect to neighboring, not-selected sample sites in a manner which can be perceived by the human eye.

6. The deposition aid of claim 1, wherein the at least one two-dimensional optical image is sized to cover all of the sample sites simultaneously.

7. The deposition aid of claim 1, wherein the microprocessor or equivalent thereof has an electrical interface for one of data input and data output.

8. The deposition aid of claim 1, wherein the microprocessor or equivalent thereof has a memory for the assignment and acquisition of identification tags of samples and sample sites.

9. The deposition aid of claim 1, further comprising adapter pieces which can be placed in the holder so that standardized sample supports for ionization via matrix-assisted laser desorption fit tightly into the holder.

10. The deposition aid of claim 1, wherein the at least one two-dimensional image includes an area which highlights a selected sample site and an area which displays information to a user.

11. The deposition aid of claim 1, further comprising at least one of an interface for the manual confirmation of the deposition and a device for the automatic detection of a manual deposition process.

12. The deposition aid of claim 11, wherein the device for automated detection comprises a scattered light sensor that detects changes in scattered light behavior on the sample support, which changes are indicative of a manual deposition process.

13. The deposition aid of claim 11, wherein the interface for confirming the deposition comprises a scattered light sensor which detects manually produced changes in scattered light in a predetermined area of the sample support.

14. The deposition aid of claim 1, wherein the non-orthogonal angle relative to the plane of the sample support is substantially greater than 15°.

15. A deposition aid for manual preparation of samples on a sample support for subsequent ionization via matrix-assisted laser desorption, the aid comprising:

a base plate containing a holder for a sample support which has several sample sites;

a guidance system which selects one of the several sample sites, based on configuration data of the sample sites on the sample support;

a vertical support located at one side of the base plate;

a video projector mounted on the vertical support that communicates with and is controlled by the guidance system and projects onto at least a portion of the sample sites, at a non-orthogonal angle relative to a plane of the sample support, at least one two-dimensional optical image that is constructed so that the selected sample site is highlighted with respect to neighboring, not-selected sample sites in a manner which can be perceived by the human eye; and optics, including at least one of a lens and a mirror, that condition the image to be displayed substantially without distortion.

* * * * *